US005632397A

United States Patent [19]

Fandeux et al.

[11] Patent Number: 5,632,397

[45] Date of Patent: May 27, 1997

[54] AXIALLY-CRUSHABLE BOTTLE MADE OF PLASTICS MATERIAL, AND TOOLING FOR MANUFACTURING IT

[75] Inventors: Isabelle Fandeux, Evian-les-Bains; Jean-Marie Petre, Bons-en-Chablais, both of France

[73] Assignee: Societe Anonyme des Eaux Minerales d'Evian, Evian-les-Bains, France

[21] Appl. No.: 305,033

[22] Filed: Sep. 13, 1994

[30] Foreign Application Priority Data

Sep. 21, 1993 [FR] France ..... 93 11225
Feb. 17, 1994 [FR] France ..... 94 01811

[51] Int. Cl.[6] ..... B65D 1/40; B65D 23/00

[52] U.S. Cl. ..... 215/382; 215/900; 220/666; 220/672; 220/907

[58] Field of Search ..... 215/900, 381, 215/382; 220/666, 667, 907, 672

[56] References Cited

U.S. PATENT DOCUMENTS

| | | | |
|---|---|---|---|
| 3,438,578 | 4/1969 | Peterson et al. | 215/900 X |
| 3,872,994 | 3/1975 | Hyde | 215/900 X |
| 3,918,603 | 11/1975 | Hatada | 215/900 X |
| 4,213,933 | 7/1980 | Cambio . | |
| 4,316,551 | 2/1982 | Belokin, Jr. | 220/667 |
| 4,324,340 | 4/1982 | Belokin, Jr. | 215/900 X |
| 4,572,412 | 2/1986 | Brach et al. | 215/382 X |
| 4,790,361 | 12/1988 | Jones et al. | 215/900 X |
| 4,955,493 | 9/1990 | Touzant | 215/382 X |
| 5,100,017 | 3/1992 | Ishinabe et al. | 220/669 |
| 5,174,458 | 12/1992 | Segati . | |
| 5,201,438 | 4/1993 | Norwood | 215/900 X |
| 5,209,372 | 5/1993 | Norwood | 215/900 X |
| 5,370,250 | 12/1994 | Gilbert | 220/666 X |

FOREIGN PATENT DOCUMENTS

| | | | |
|---|---|---|---|
| 408929 | 1/1991 | European Pat. Off. . | |
| 528754 | 2/1993 | European Pat. Off. . | |
| 2259754 | 2/1974 | France . | |
| 2259754 | 8/1975 | France . | |
| 2316132 | 1/1977 | France . | |
| 2504095 | 10/1982 | France | 220/666 |
| 2607109 | 5/1988 | France . | |
| 53-143485 | 12/1978 | Japan . | |
| 4551036 | 3/1993 | Japan | 220/666 |
| WO94/05555 | 3/1994 | WIPO . | |

*Primary Examiner*—Sue A. Weaver
*Attorney, Agent, or Firm*—Bell, Seltzer, Park & Gibson

[57] ABSTRACT

An axially crushable bottle made of plastics material and formed with transverse corrugations over the major portion of its height has fold starters in each corrugation, which fold starters project outwards from the bottoms of the corrugations and are angularly offset from one corrugation to another.

29 Claims, 4 Drawing Sheets

FIG. 5
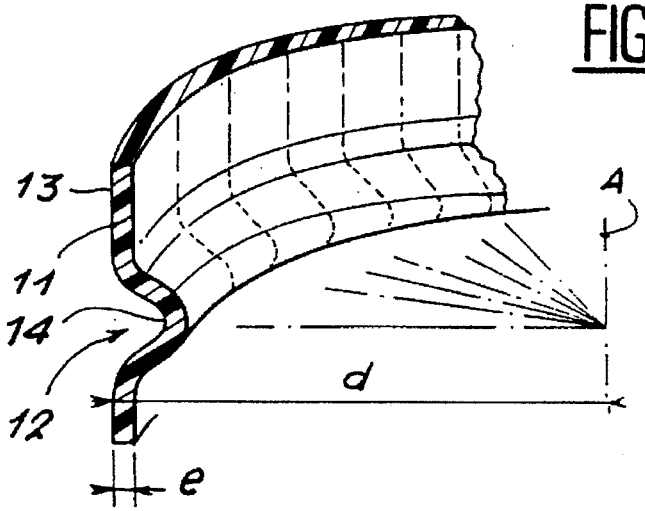
FIG. 6
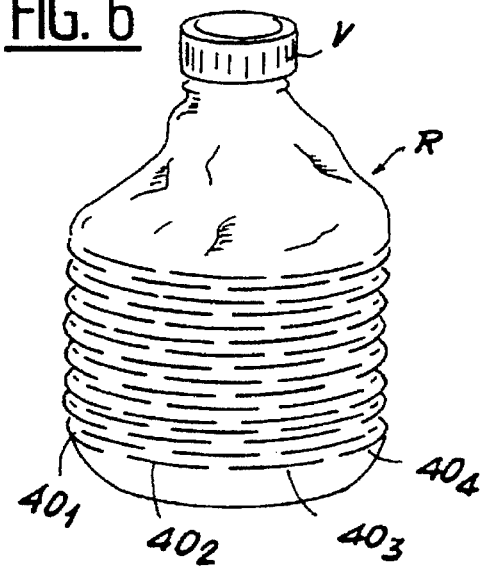
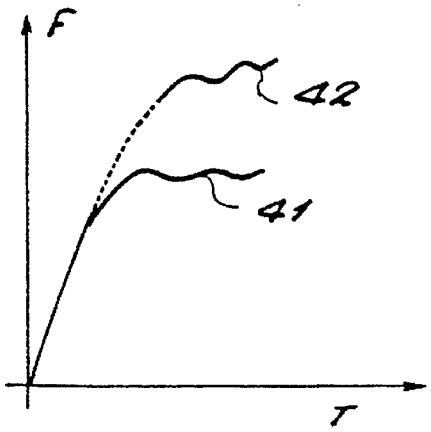
FIG. 7

FIG.8
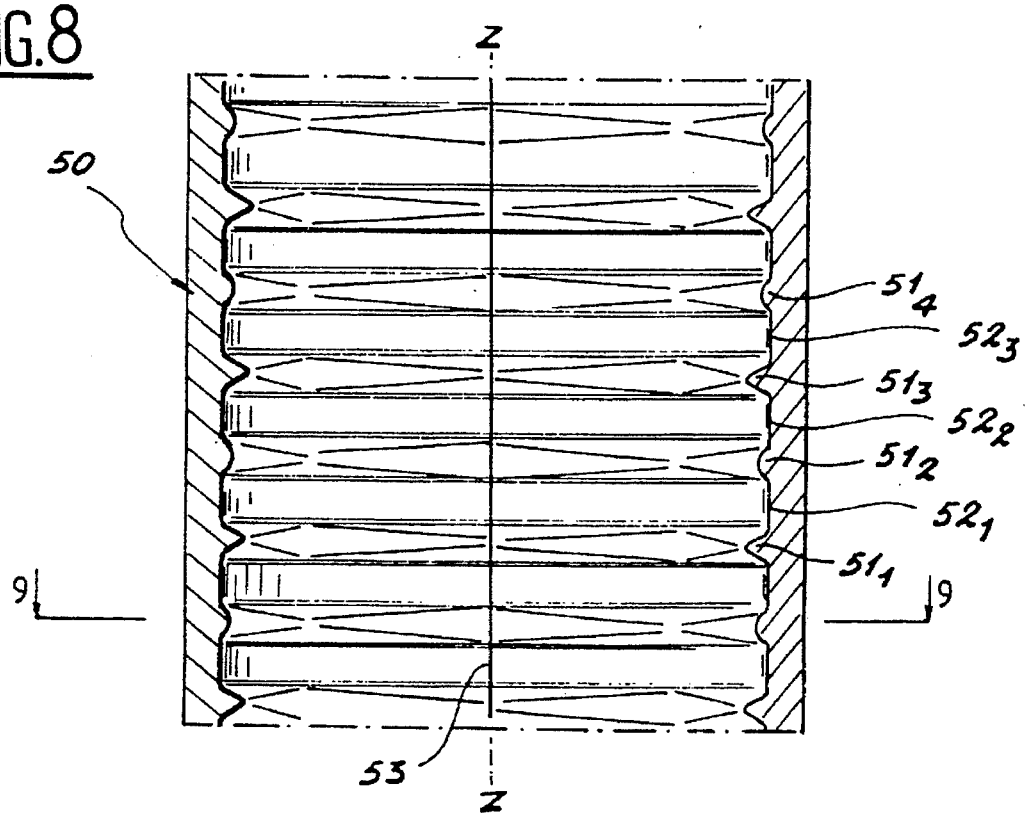
FIG.9
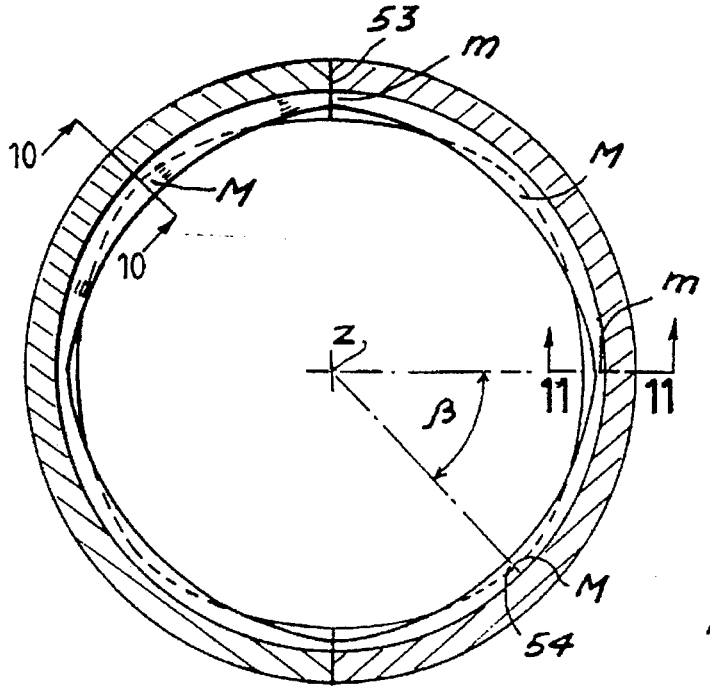
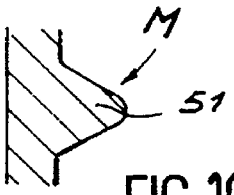
FIG.10
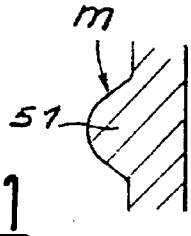
FIG.11

AXIALLY-CRUSHABLE BOTTLE MADE OF PLASTICS MATERIAL, AND TOOLING FOR MANUFACTURING IT

FIELD OF THE INVENTION

The invention relates to a plastics material bottle that can be crushed by applying an axial force thereto, and which consequently differs from bottles that are crushed by applying a force transversely to their longitudinal axes, as described in EP-408 929 or EP-528 754.

The invention also relates to tooling for manufacturing such a crushable bottle made of plastics material.

BACKGROUND OF THE INVENTION

There already exist numerous proposals for crushable bottles made of plastics material, e.g. in U.S. Pat. No. 5,209,372 which describes a bottle whose side wall has helical ribs between its bottom and its top, or U.S. Pat. No. 5,201,438 and U.S. Pat. No. 4,790,301 which describe a bottle whose side wall is made up of plane facets, or indeed FR-2 316 132 and FR-2 259 754 which show bottles in which the side wall is formed by juxtaposing curved diamond-shapes that are defined by ribs and whose diagonals constitute fold creases. The complexity of the shapes of some of those known bottles makes them difficult to manufacture. Others have no transverse undulations, such that after bottling they cannot be used to make up palletized loads that are handled, transported, and stored in the form of stacks since in such stacks the bottles in the bottom layer must withstand high pressure stresses, and if there are no transverse undulations, then they do not provide the necessary "damping".

Consequently, the problem arises of providing a plastics material bottle that is crushable by applying an axial force, whose general shape is close to that of known bottles (to enable it to be used in existing bottling factories without alteration), which is capable of being stored and transported in the form of palletized loads and of stacks, and which is reduced, after crushing, to a residue of small volume whose shape is substantially stable, i.e. permanent and practically incapable of elastic deformation.

OBJECTS AND SUMMARY OF THE INVENTION

In general terms, an object of the invention is to provide a satisfactory solution to the problem posed.

In this respect, an object of the invention is to provide such a plastics material bottle of the same general shape and size as conventional plastics bottles having transverse undulations, and which is capable of being used in a bottling factory without requiring the manufacturing and filling lines to be altered, which can subsequently be handled in the usual way, in particular for making up palletized loads and stacks, but which nevertheless and unlike known bottles is also easily crushed to form a residue of small volume when an axial force is applied thereto, which force is small both at the beginning of crushing and while crushing is taking place.

Another object of the invention is to provide a plastics bottle which can be crushed axially by applying a small force thereto and which can be crushed completely without difficultly in spite of having a middle portion that is waisted or of a special shape for grasping purposes.

Another object of the invention is to provide such a bottle that is capable of being manufactured out of plastics material like ordinary bottles, i.e. by using hollow body manufacturing methods such as injection blow molding, extrusion blow molding, or the like.

Another object of the invention is to provide such a bottle that is capable of being made out of different materials, be they simple or composite, multilayer or compound, such as polyolefins, polyesters, or PVCs, and in particular out of polyethylene terephthalate (PET).

Another object of the invention is to provide such a bottle that is usable by a consumer in the same manner as ordinary bottles, equally well when opening and/or reclosing it, and when pouring out its contents.

Finally, an object of the invention is to provide such a bottle whose cost, which is directly proportional to the quantity of material used, is entirely comparable to that of known bottles, thereby enabling it to be used on an industrial scale.

The invention also seeks to provide tooling for manufacturing such a bottle, in particular a mold of the same type as those Used in methods for obtaining hollow bodies made of plastics material.

In an axially crushable bottle of the invention made of plastics material and including transverse corrugations over the major portion of its height, said transverse corrugations have a depth, i.e. a dimension measured towards the axis of the bottle, that varies cyclically around the periphery of said corrugations between a maximum value and a minimum value.

In other words, the corrugations are of a depth such that when going round the periphery of a corrugation about the longitudinal axis of the bottle, said depth decreases from a maximum value until it reaches a minimum value and then increases from said minimum value to said maximum value, and then decreases again down to the minimum value, and so on in a manner that is periodic or cyclic.

The shape defined above for one corrugation may be the same for all of the corrugations in the side wall of the bottle, being angularly offset from one corrugation to another about the longitudinal axis of the bottle through an angle equal to $\pi/n$, where n is an integer.

In a first embodiment of the invention, the angle between the center of each arc formed by the bottom of a groove between a point of maximum depth and a point of minimum depth is equal to $\pi/n$, where n is an integer.

The depth of each corrugation may vary continuously on going around the periphery of the corrugation from the maximum value to the minimum value, and then from the minimum value to the maximum value, . . . etc.

In a variant, the opposite ends of arcs having an angle at the center equal to $\pi/n$ and extending between a point where the corrugation is of maximum depth and the following point where it is of minimum depth, are interconnected by a straight line segment.

Also according to the invention, when going round the periphery of a corrugation, the radius at the bottom of the corrugation and consequently its profile in right cross-section on a radial plane that includes the axis of the bottle, varies cyclically in correspondence with the depth of the corrugation.

A bottle structure as defined above in which the thickness of the side wall is constant gives rise, after the bottle has been crushed by applying an axial force thereto, to a solid of small residual volume whose outline in plan is substantially that of an n-sided polygon.

In a preferred embodiment of the invention, the plastics material from which the bottle is made is polyethylene terephthalate (PET).

In embodiments of the invention that have given good results, a PET bottle having a volume of 1.5 liters, an empty weight lying in the range 34 grams to 38 grams, a constant wall thickness lying in the range 0.17 mm to 0.35 mm, and an empty height lying in the range 300 mm to 340 mm, can be crushed by applying thereto an axial force of less than 10 daN(deca-newtons).

In a first advantageous implementation of such a bottle, the maximum depth of the corrugations is about 3 mm, the minimum depth is about 1.5 mm, and the flare angle $\alpha$ of the corrugation is equal to 70°.

In a second advantageous implementation of such a bottle, the maximum depth of the corrugations is about 3.86 mm, the minimum depth is about 1.7 mm, and the flare angle $\alpha$ of the corrugation is equal to 59.74°.

Plastics materials other than PET can be used for making a bottle of the invention, in particular materials that are simple or composite, multilayer or compound, of the PVC type or of the polyolefin or polyester type.

The invention may be implemented in a bottle having a cylindrical body and a substantially circular right cross-section, optionally including a waisted portion for grasping purposes, without that shape being limiting in any way, i.e. the body of the bottle could have a right cross-section that is hexagonal or orthogonal, or the body could even be substantially in the shape of a rectangular parallelepiped, for example.

Tooling for manufacturing a bottle as defined above comprises a mold suitable for use in a method for obtaining a hollow body made of plastics material, and which presents over at least the major portion of its height, transverse undulations formed by alternating ribs and grooves, where the ribs form projections which, on going round the periphery of the ribs, vary cyclically in radial extent between a minimum value and a maximum value.

The angle at the center of each rib arc between an end where it projects a minimum amount and an end where it projects a maximum amount is advantageously equal to $\pi/n$, where n is an integer.

In such a mold, the invention also provides for the above-defined shape of a rib to be the same for all of the ribs but with an angular offset through an angle equal to $\pi/n$ about the longitudinal axis of the mold on going along said axis.

Also according to the invention, the radius at the top of the rib varies cyclically when going around the periphery of the rib, in correspondence with the extent to which said rib projects.

In a second preferred embodiment of the invention, the corrugations are of substantially constant depth over the major portion of their periphery, and from place to place they include fold starters formed to project radially outwards on the bottoms of the corrugations, said fold starters being uniformly distributed and angularly offset about the axis of the bottle from one corrugation to another.

In surprising, but highly effective manner, such fold starters formed by protections on the bottoms of the corrugations greatly facilitate axial crushing of the bottle: the axial force that must be applied to the bottle in order to crush it is less than 10 daN, and the bottle can be completely crushed even if it includes a middle portion that is waisted or of some other special shape for grasping purposes.

In general, the fold starters constituted by the above-specified projections have the following features:

in a plane that includes the axis of the bottle, each fold starter includes a generator line or ridge line that is inclined relative to said axis by a determined angle;

the value of said angle lies in the range 0° to 45°; and the generator line or ridge line extends from one flank of the corrugation to the other, being connected to one of said flanks by a circular arc whose concave side faces outwards.

In a first embodiment of the fold starters, the shape of each fold starter in the midplane of its corrugation that extends perpendicularly to the axis of the bottle is that of a circular arc with the concave side of the arc facing towards the inside of the bottle.

In a variant embodiment, each fold starter is V-shaped in said midplane of its corrugation, with the tip of the V-shape pointing towards the outside of the bottle.

The angular extent of each fold starter about the axis of the bottle lies in the range about 0.2 radians to about $2\pi/n$, where n is the number of fold starters per corrugation.

The angular offset of the fold starters from one corrugation to the next is $\pi/n$, where n is the number of fold starters per corrugation.

The invention also provides a mold for manufacturing an axially crushable bottle out of plastics material, wherein the inside surface of the mold includes circular ribs corresponding to the transverse corrugations of the bottle to be manufactured and including hollows or cavities complementary to the fold starters described above.

BRIEF DESCRIPTION OF THE DRAWINGS

Other features and advantages of the invention appear from the following description given by way of example and made with reference to the accompanying drawings, in which:

FIG. 5 is a diagrammatic perspective view showing a portion of the wall of a bottle of the invention;

FIG. 6 is a diagrammatic perspective view showing the bottle after it has been crushed;

FIG. 7 is a graph plotting applied crushing force as a function of time;

FIG. 8 is a fragmentary section through a mold of the invention;

FIG. 9 is a section view on line 9—9 of FIG. 8;

FIG. 10 is a section on line 10—10 of FIG. 9, but on a larger scale;

FIG. 11 is a section on line 11—11 of FIG. 9, but on a larger scale;

MORE DETAILED DESCRIPTION

Figure 1:
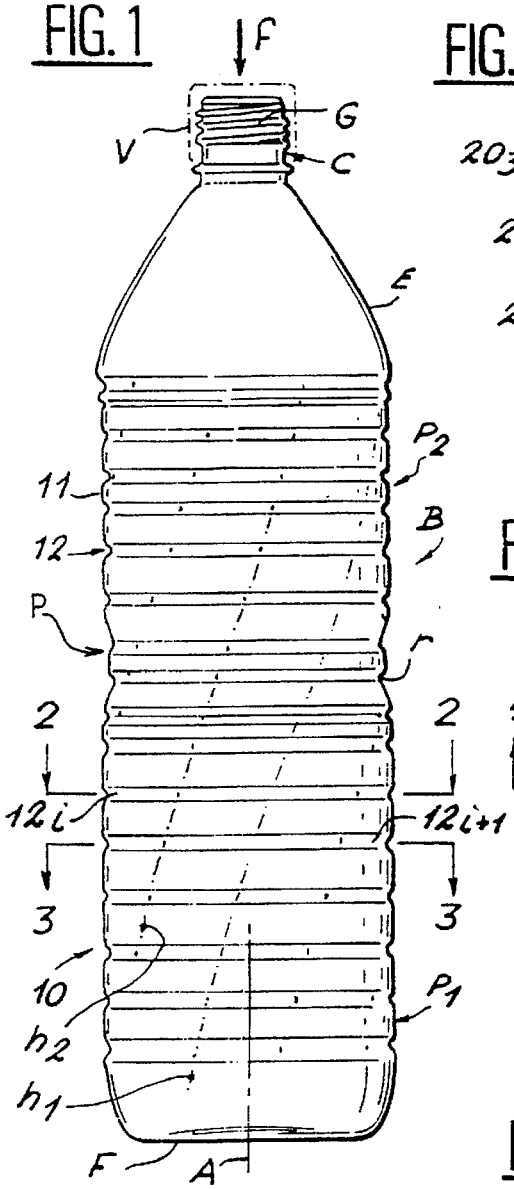
FIG. 1 is an elevation view of a bottle of the invention.

Reference is made initially to FIG. 1 which shows a bottle B of the invention that is made of a plastics material, advantageously of polyethylene terephthalate (PET) although that specific substance is not limiting in any way, it being also possible to make the bottle out of a material that is simple or composite, multilayer or compound, such as PVC or a polyolefin or a polyester. The bottle B has a bottom F, a side wall P that is generally cylindrical in shape having two portions $p_1$ and $p_2$ that are separated by a portion (r) that is waisted for grasping purposes, the top portion $p_2$ being extended towards a neck C by a smooth tapering portion E which, in a variant, could have relief thereon to constitute a trademark or the like. The neck C has a thread G suitable for receiving a screw cap V. The bottle B which is manufactured using conventional techniques for making hollow bodies out of plastics material, e.g. injection blow molding, has a side wall P that is shaped so that after the bottle has been emptied, it can be crushed by applying an axial force f of small magnitude, thereby giving rise to a residue R (FIG. 6) of a volume that is considerably smaller than that of the bottle in its initial condition, whether full or empty.

To do this, the wall of the bottle which is of constant thickness lying in the range 0.17 mm to 0.35 mm depending on the weight of an initial preform, is shaped so that its zone made up of the portions $p_1$ and $p_2$ has undulations or corrugations 10 comprising right cylindrical portions or lands 11 and depressed portions or grooves 12 (FIGS. 1 and 5).

Whereas the lands 11 have outside surfaces 13 at a constant distance (d) from the axis A of the bottle and lie on a right circular cylinder about the axis A, the grooves 12 are of a depth that varies when going along said corrugations, i.e. their size as measured between their bottoms 14 and the cylindrical outside surface defined by the lands 13 varies circumferentially.

More precisely, said depth varies around the periphery of each corrugation between a maximum value (a) and a minimum value (b), then from said minimum value back to said maximum value (a), . . . etc. (FIGS. 2, 3, 3A, and 3B), said variation in depth being obtained when the thickness (e) of the side wall of the bottle remains constant, by giving the corresponding rib of the mold in which the bottle is shaped a distance from the axis of the mold that varies on going along said rib, as explained below.

Also in accordance with the invention, the variation in the depth of each groove is periodic or cyclic on going along said groove, i.e. each arc $\mathbf{20}_1$, $\mathbf{20}_2$, $\mathbf{20}_3$, . . . etc. of the groove and extending between successive points of extreme depths 21, 22, 23, . . . , etc., i.e. where the groove is alternately at its smallest depth and at its largest depth . . . etc., occupies an angle at the center that is equal to $\pi/n$, where n is an integer. It will be understood by those of skill in the art that, as used herein, the term "$\pi$" is intended to express an angular unit of measure expressed in radians; although, of course, the term can be equivalently expressed in degrees. For example, the term ("$\pi/n$") can be read "($\pi/n$) radians", the term "$\pi/4$" can be read "$\pi/4$ radians" (which is also expressible as 45°), and the like.

Figure 2:
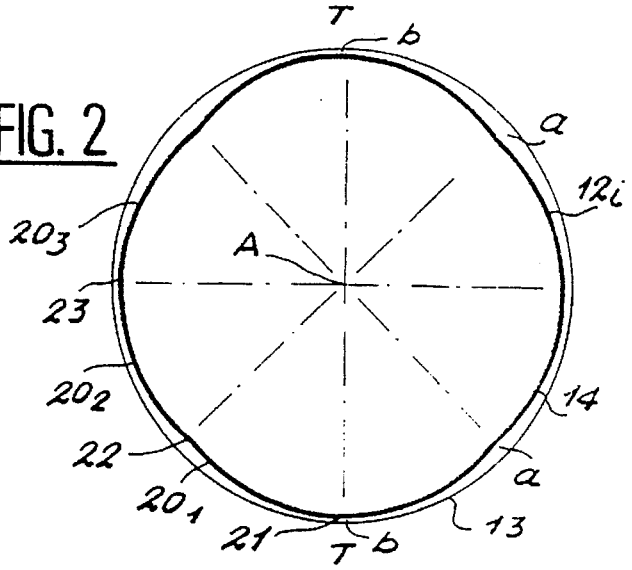
FIG. 2 is a section view on line 2—2 of FIG. 1, but on a larger scale.
Figure 3:
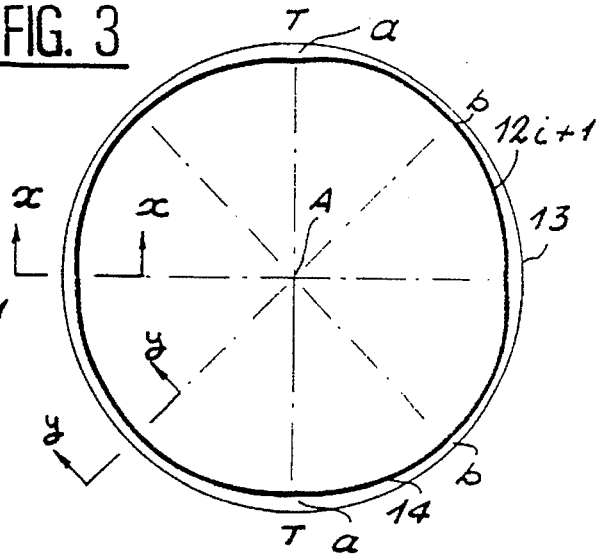
FIG. 3 is a section view on line 3—3 of FIG. 1, and on the same scale as FIG. 2.

For example, when n is equal to 4, then each arc $\mathbf{20}_1$,$\mathbf{20}_2$, $\mathbf{20}_3$, corresponds to an angle at the center of 45°, as can clearly be seen in FIGS. 2 and 3 which show two successive grooves $\mathbf{12}_i$ and $\mathbf{12}_{i+1}$ as they appear on the side wall of the bottle on going downwards along the axis A. As shown by these figures, in which the trace of a common longitudinal plane T—T serve as a reference axis, the shape of the corrugations is the same, but successive corrugations are offset angularly through $\pi/n$, in this case 45°, about the longitudinal axis A of the bottle, groove $\mathbf{12}_i$ thus being at its smallest depth (b) in the plane T—T whereas the groove $\mathbf{12}_{i+1}$ is at its greatest depth (a) in said plane, which state of affairs can also be described by stating that lines interconnecting the smallest depths or the greatest depths of adjacent grooves in the bottle trace respective helices around the axis of the bottle, as represented by chain-dotted lines $h_1$, $h_2$, . . . , etc., in FIG. 1.

Figure 3A:
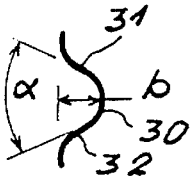
FIGS. 3A and 3B are section views on lines x—x and y—y of FIG. 3, and on a larger scale.
Figure 3B:
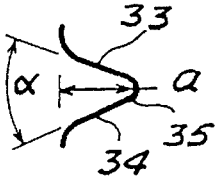

As also shown in FIGS. 3A and 3B, the flare angle $\alpha$ of each corrugation is constant but the radius at the bottom of the groove (and consequently the profile of its right cross-section in a radial plane containing the axis A of the bottle and marked x—x and y—y respectively in FIGS. 3A and 3B) varies cyclically on going round the periphery of the groove, in correspondence with the depth thereof. Where the groove has its smallest depth, its profile is as shown in FIG. 3A, i.e. it has a curved bottom 30 of relatively large radius connected to the adjacent lands 13 via shaped portions 31 and 32 that give the right cross-section a shallow U-shape, whereas where the groove is at its greatest depth, as shown in FIG. 3B, the right cross-section is generally V-shaped with faces 33 and 34 at the angle $\alpha$ and interconnected by a curved bottom 35 of relatively small radius.

In the embodiment as described above, the depth of each groove 12 varies smoothly on going round the periphery of the groove between its points of extreme depth 21 and 22, 22 and 23, etc . . . where the groove has its smallest depth, then its greatest depth, . . . , etc.

Figure 4:
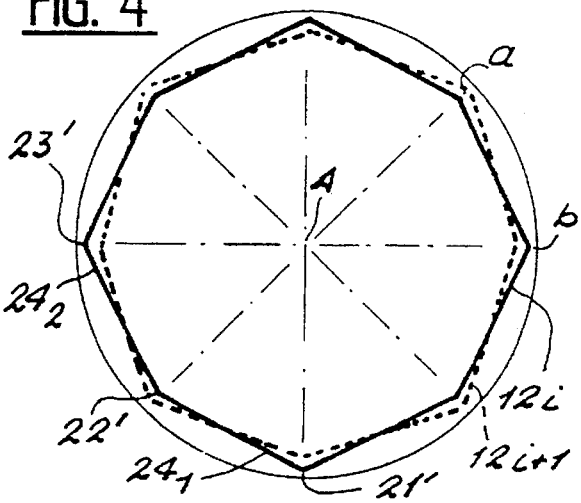
FIG. 4 is a section view analogous to those of FIGS. 2 and 3, but for a different embodiment.

In the embodiment shown diagrammatically in FIG. 4, where the solid line corresponds to the right cross-section of a groove $\mathbf{12}_i$ and the dashed line represents the right cross-section of a groove $\mathbf{12}_{i+1}$, the successive points of extreme depth 21', 22', 23', . . . , etc. where the groove is alternately of smallest depth and of greatest depth, are interconnected by straight line segments, $\mathbf{24}_1$, $\mathbf{24}_2$, . . . , etc., with each segment corresponding to an angle at the center equal to $\pi/n$ (equal to 45° as in the preceding embodiment), the grooves $\mathbf{12}_i$ and $\mathbf{12}_{i+1}$ being offset in this case likewise by 45° about the longitudinal axis A of the bottle on moving along the axis of the bottle.

When a bottle of the type shown in FIGS. 1 to 3 or FIG. 4 is subjected to an axial force (f) directed along the axis of the bottle (the bottle naturally then being empty and its cap being removed), the bottle is transformed in to a residue R (FIG. 6) of volume that is considerably less than that of the bottle in its initial condition whether full or empty. As shown in FIG. 6, the residue has a portion whose outline in plan is substantially that of an n-sided polygon having sides $\mathbf{40}_1$, $\mathbf{40}_2$, $\mathbf{40}_3$, $\mathbf{40}_4$, . . . , etc., said volume being maintained, after the bottle has been crushed, by screwing the cap V back onto the neck C.

The structure of the bottle of the invention makes it possible to crush the bottle by application of an axial forced of low value, less than 10 daN, with this applying both at the beginning of crushing and while crushing is taking place, as shown by curve 41 (FIG. 7) that relates to a bottle of the invention, whereas curve 42 represents a crushing force that increases constantly over time as is required for an ordinary bottle.

Tests relating to the materials used and to the shapes of the corrugations have provided the results that appear in Tables I and II below.

In Table I, which relates solely to 1.5 liter bottles made of polyethylene terephthalate, APO designates a bottle having the same general shape as that shown in FIG. 1, but not having the features of the invention, while USI designates a bottle having the same general shape but without the waisted portion (r) and likewise without the features of the invention. In contrast, "shape 4" designates a bottle of the invention, of the same type as that shown in FIG. 1, with a maximum groove depth (a) of 3 mm and a minimum groove depth (b) of 1.5 mm, and for which the flare angle α is equal to 70°.

It can be seen that for a bottle of the invention, which is lighter in weight than an ordinary bottle, the force required for initiating deformation of the bottle is reduced, and in addition the force required to continue deformation increases relatively little. In spite of this result, the strength of a full bottle when subjected to vertical compression is of the same order as that of ordinary bottles, which means that bottles of the invention can be handled and stocked in the form of palletized loads and of stacks.

Table II gives the results of comparable tests between a PVC bottle that did not have the features of the invention, and PET bottles, some of which are labelled as having ordinary corrugations and did not present the features of the invention, while other PET bottles did have the features of the invention. The references APO and USI have the same meanings as in Table I, and the reference RAM designates a bottle of the APO type but in which the conical portion E includes a design in relief.

The corrugation shape designated by the reference "shape 4" is the same as that defined above for Table I, whereas the shape referenced "shape 6" has grooves with a minimum depth of 1.7 mm, a maximum depth of 3.86 mm, and a flare angle α that is equal to 59.74°.

As in Table I, contraction under a load of 10 daN represents the decrease in height of the bottle and thus the ease with which it can be crushed, whereas the values relating to vertical compression of the stocked full bottle show the force required to cause the bottle to break, and represent the ability of a bottle to conserve its shape while being handled in the form of palletized loads and stacks. This value for bottle strength while being handled under such conditions is confirmed by loading tests (12 bottles subjected to 338 kg) as in Table I that represent the contraction in millimeters of the bottom layer in a stack where a first palletized load is supporting another palletized load on top.

TABLE I

| BOTTLES MADE OF PET | Bottles with ordinary undulations without the invention | | Bottle of the invention shape 4 with waist |
|---|---|---|---|
| VOLUME: 1.5 LITERS | APO | USI | for grasping purposes |
| Weight in grams (g) | 38 | 38 | 34 |
| Vertical compression: EMPTY | | | |
| F to initiate deformation (DaN) | 12 | 14 | 8.5 |
| F to continue deformation (DaN) | | | 9.7 |
| Vertical compression: FULL | | | |
| Breaking strength (DaN) | 140 | 95 | 85 |
| Contraction (mm) | 8.05 | 5.9 | 6.8 |
| Contraction under 35 DaN (mm) | 4 | 4.7 | 3.5 |
| Contraction when flat (mm) | 4.8 | 8.6 | 6.3 |
| 7 DaN | | | |
| Under loading of 338 kg (for 12 bottles) | 3.5 | 2.9 | 3 |
| Contraction (mm) at t = 0 | | | |

TABLE II

| | | PET | | | | | | | |
|---|---|---|---|---|---|---|---|---|---|
| | PVC | Bottles with ordinary undulations without the invention | | | | | Bottles of the invention | | |
| BOTTLE VOLUME | shape | | | | | | | | |
| 1.5 LITERS | APO | USI | APO | USI | APO | RAM | APO | APO | RAM |
| Corrugation type | | | | | | | shape 4 | shape 6 | shape 6 |
| Weight: empty bottle (g) | 43 | 36.5 | 36.5 | 37.5 | 37.5 | 36 | 34 | 36 | 36 |
| Height: empty bottle (mm) | 320 | 304 | 320 | 304 | 320 | 320 | 320 | 320 | 319 |
| Vertical compression: EMPTY | | | | | | | | | |
| Contraction under 10 DaN | 3 | 4 | 5.1 | 2.8 | 2.8 | 3 | 70 | 74.5 | 75 |
| Residual height | 317 | 300 | 314.9 | 301.2 | 317.2 | 317 | 250 | 245.5 | 245 |
| Force to start crushing | 17 | 12.6 | 10.3 | 14.2 | 13.8 | 11.86 | 8 | 9 | 8 |
| Vertical compression: FULL | 70 | 72 | 93.4 | 95 | 140 | 168 | 85.4 | 144 | 121 |
| Breaking strength (DaN) | | | | | | | | | |
| Under loading of 388 kg (for 12 bottles) | 3.6 | 3.5 | | 2.9 | 4.2 | | 3 | 3.7 | 3.66 |
| Contraction (mm) at t = 0 | | | | | | | | | |

A crushable bottle made of plastics material as described is obtained by a method of manufacturing hollow bodies, e.g. extrusion blow molding or injection blow molding, and using tooling in particular a mold having two shell-like portions as shown in FIGS. 8 to 11. In such a mold, described and shown herein for obtaining a bottle of the "shape 6" type, the side wall 50 has ribs $\mathbf{51}_1$, $\mathbf{51}_2$, $\mathbf{51}_3$, $\mathbf{51}_4$, . . . on its inside face that are connected to one another by right circular cylindrical portions $\mathbf{52}_1$, $\mathbf{52}_2$, $\mathbf{52}_3$, . . . , etc. As shown in FIG. 9, each rib 51 is shaped to provide a projection having a radial extent which, on going round the periphery of a rib, varies in cyclic manner between a minimum value (m) and a maximum value (M), with the angle at the center $\beta$ of each rib arc between a point 53 at one extreme height (of minimum projection) and an adjacent point 54 of the other extreme height (of maximum projection) being equal to $\pi/n$, where n is an integer.

Also in accordance with the invention, the radius at the top of the rib 51, and consequently the profile of the right section in a radial plane containing the axis Z of the mold varies in cyclic manner on going around the periphery of the rib 51 in correspondence with the extent to which the rib projects, the profile at maximum projection (M) being as shown in FIG. 10 and the profile at minimum projection (m) being as shown in FIG. 11.

The above-defined shape for a rib 51 is the same for all of the ribs on the side wall of the mold, but it is angularly offset about the longitudinal axis Z of the mold through an angle of $\pi/n$ on going from one rib to the next in the axial direction.

Figure 12:
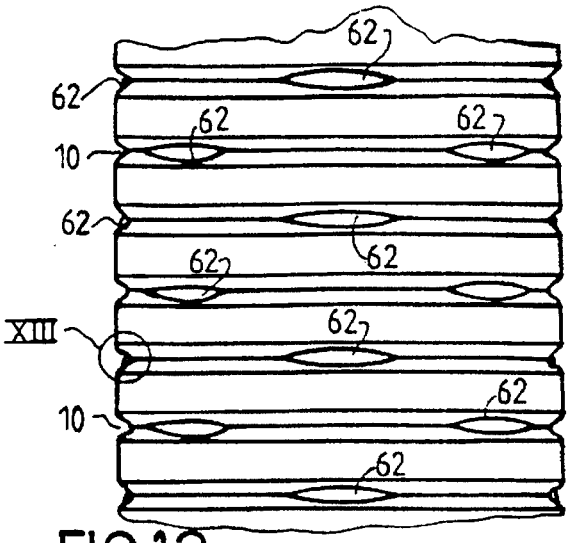
FIG. 12 is a fragmentary view of a bottle constituting a preferred embodiment of the invention.
Figure 13:
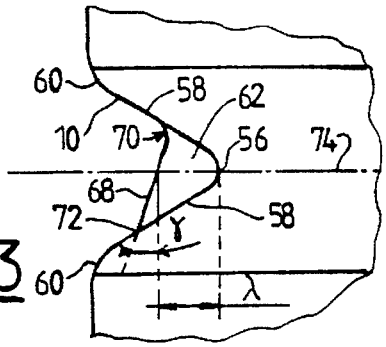
FIG. 13 is a view on a larger scale showing a detail in circle XIII of FIG. 12.
Figure 14:
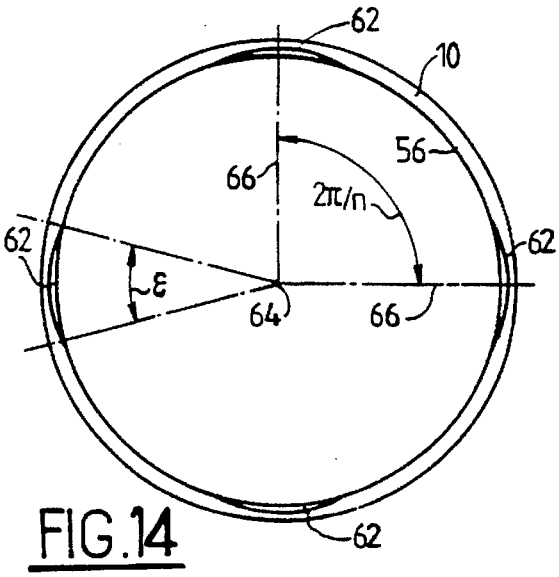
FIG. 14 is a diagram showing the shape of a corrugation as seen from above.

In the embodiment of FIGS. 12 to 14, the corrugations 10 of the bottle have, as before, a V-shaped cross-section with a rounded tip 56 directed towards the inside of the bottle, with the two straight branches 58 of the V-shape being connected via circular arcs 60 to the cylindrical side wall of the bottle, and in this embodiment, each corrugation 10 includes fold starters 62 which are angularly distributed uniformly about the longitudinal axis 64 of the bottle and which project from the bottoms of the corrugations 10 towards the outside of the bottle, with the corrugations 10 being of constant depth apart from the fold starters.

The shape of the fold starters 62 can be defined as follows:

in the plan view of FIG. 14, they are curved, e.g. following a circular arc, with the concave side of the curve facing towards the inside of the bottle;

each starter has a midplane of symmetry 66 that includes the axis of the bottle;

the midplanes 66 of two consecutive fold starters in the same corrugation 10 form an angle between them of $2\pi/n$, where n is the number of fold starters per corrugation;

the angular extent s of each fold starter about the bottle axis 64 lies in the range about 0.2 radians to $2\pi/n$;

in its midplane of symmetry 66 that includes the axis of the bottle, each fold starter 62 is defined by a generator line or ridge line 68 which extends between the two flanks 58 of the corrugation and which is connected to one of said flanks by a circular arc 70 whose concave side faces towards the outside and has a radius lying in the range about 0.5 mm to the radius of the circular arc that is tangential to the generator line 68 and to the flank 58 of the corrugation;

the generator line or ridge line 68 is a straight line connected to the other flank 58 of the corrugation via a rounded portion 72 of minimum radius of curvature, the connection line being curved in shape in a plane that is perpendicular to the axis of the bottle;

the generator line or ridge line 68 is inclined relative to the longitudinal axis of the bottle by an angle $\gamma$ lying in the range 0 to about 45°; and the radial extent $\lambda$ of the fold starter 62 in the midplane 74 of the corrugation 10 is substantially equal to or slightly less than half the depth of the corrugation 10 (the radial extent $\lambda$ being the distance between the bottom 56 of the corrugation and the point of intersection between the ridge line 68 and the midplane 74 of the corrugation).

From one corrugation to the next, the fold starters 62 are offset angularly through an angle equal to $\pi/n$, where n is the number of fold starters per corrugation.

The number n lies typically in the range 3 to 20.

In the example of FIGS. 12 and 13, the ridge lines 68 of the fold starters are inclined to slope downwards and outwards. However, it is also possible to use an orientation that is symmetrical to that shown about a perpendicular to the axis of the bottle.

Figure 15:
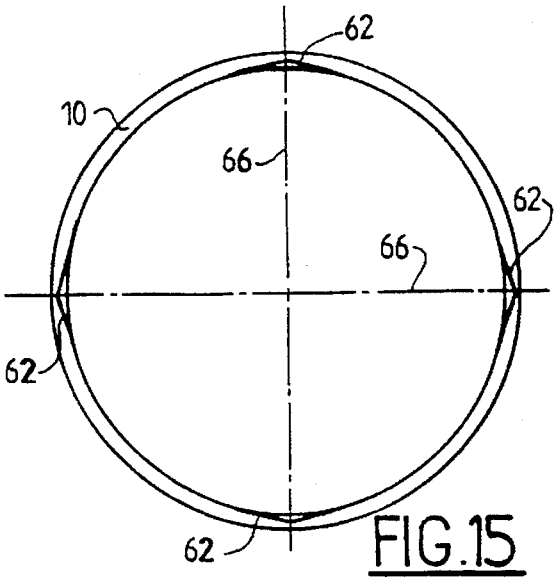
FIG. 15 is a view that corresponds to FIG. 14, but for a variant embodiment.

In a variant embodiment shown in FIG. 15, the fold starters 62 as seen from above are no longer curved or arcuate in shape, but are in the form of a very flat V-shapes with straight sides, the tip of each V-shape lying in the plane of symmetry 66 of the corresponding starter, i.e. the plane that includes the axis 64 of the bottle.

When such a bottle is subjected to an axial compression force, the bottle being empty and its stopper removed, it is transformed into a residue of small volume as constituted by a stack of n-sided polyhedrons, said small volume being maintained after crushing by screwing the cap back onto the neck of the bottle.

One of the essential features of a bottle of the type shown in FIGS. 12 to 15 is that it requires a smaller axial force to crush it. Accompanying Table III gives the results of comparative tests performed on known bottles of the prior art and on a bottle as shown in FIGS. 12 and 13, having four fold starters per corrugation, with the angular extent e of each fold starter being about 26°, with the angle of inclination $\gamma$ of the ridge lines 38 relative to the axis of the bottle being 21°, and with the radial extent $\gamma$ of the fold starters being about 1.4 mm (the depth of the corrugation being 3 mm).

In the table, references APO designate bottles having the general shape shown in FIG. 1 but not including the features of the invention, and references USI designate bottles likewise having the general shape shown in FIG. 1, but not including a waisted portion for grasping purposes and likewise not including the features of the invention. References RAM designate bottles of the APO type, but in which the top portion E includes a design in relief. All of the bottles were made of PET and had a volume of 1.5 liters.

It can be seen that the bottle of the invention is crushed by applying an axial force of 6 daN, which is relatively very small, but that when full and closed, it nevertheless presents mechanical characteristics that are fairly similar to those of known bottles.

That makes it possible for bottles of the invention to be manufactured, filled, closed, handled, transported, and used like prior art bottles even though they are easily crushed when empty so as to take up a much smaller volume after they have been used.

The volume saving obtained by crushing can be quantified as the ratio of the number of crushed bottles to the number of identical but not crushed bottles that can be contained in a receptacle of given shape and volume.

For bottles of the invention, this ratio lies in the range 2.5 to 4 as a function of the volume and the shape of the receptacle.

TABLE III

| BOTTLES MADE OF PET | Bottles with ordinary prior art undulations | | | | | Bottles of the invention |
|---|---|---|---|---|---|---|
| Volume: 1.5 liters | USI | APO | USI | APO | RAM | RAM |
| Weight in grams of empty bottle | 36.5 | 36.5 | 37.5 | 37.5 | 36 | 36 |
| Height of bottle (mm) | 304 | 320 | 304 | 320 | 320 | 320 |
| Vertical compression of empty bottle | | | | | | |
| Contraction under a load of 10 DaN (mm) | 4 | 5.1 | 2.8 | 2.8 | 3 | 80.1 |
| Residual height (mm) | 300 | 314.9 | 301.2 | 317.2 | 317 | 239 |
| Force to initiate deformation (DaN) | 12.6 | 10.3 | 14.2 | 13.8 | 11.86 | 6 |
| Vertical compression of bottle when full and closed - Breaking strength (DaN) | 72 | 93.4 | 95 | 140 | 168 | 91 |
| Contraction (mm) under loading of 388 kg (for 12 bottles, full and closed) | 3.5 | | 2.9 | 4.2 | | 2.7 |

We claim:

1. An axially crushable bottle made of plastics material, the bottle comprising transverse corrugations over a major portion of its height, said transverse corrugations comprising a cylindrical wall portion and a depressed groove portion, wherein said transverse corrugations have a depth, i.e., a dimension measured towards the axis of the bottle, that varies cyclically around the periphery of said groove portion of said corrugations between a maximum value and a minimum value, and wherein groove portions of successive transverse corrugations are separated by said cylindrical wall portion.

2. A bottle according to claim 1, wherein the angle at the center of each arc formed along the bottom of a corrugation groove between a point where its depth is at a maximum and a following point where its depth is at a minimum is equal to $\pi/n$ radians, where n is an integer.

3. A bottle according to claim 1, wherein all of the corrugations are of the same shape and wherein two successive corrugation groove portions are angularly offset about the longitudinal axis of the bottle so that respective minimum or maximum depths of successive corrugation groove portions are not longitudinally aligned.

4. A bottle according to claim 1, wherein the depth of each corrugation varies continuously when going around the periphery of the corrugation from the maximum value to the minimum value, then from the minimum value to the maximum value, . . . , etc.

5. A bottle according to claim 1, wherein the opposite ends of arcs formed on the bottoms of the corrugation grooves between points of extreme depth and having an angle at the center equal to $\pi/n$ radians are interconnected by straight line segments.

6. A bottle according to claim 1, wherein the bottom radius of each corrugation groove portion varies cyclically on going around the periphery of the corrugation, in correspondence with the depth of the corrugation groove portion.

7. A bottle according to claim 1, wherein, after it has been crushed by applying an axial force, it is reduced to a solid of small volume whose outline in a plane is substantially that of an n-sided polygon.

8. A bottle according to claim 1, wherein it is made of polyethylene terephthalate.

9. A bottle according to claim 1, wherein it is made of a material that is simple or composite, multilayer or compound, such as PVC or a polyolefin or a polyester.

10. A bottle according to claim 8, wherein for a volume of 1.5 liters, its weight when empty lies in the range 34 grams to 38 grams, its height when empty lies in the range 300 mm to 340 mm, its wall thickness is constant and lies in the range 0.17 mm to 0.35 mm, and the axial force for initiating deformation and then continuing deformation thereof is less than 10 daN.

11. A bottle according to claim 10, each of said corrugations having a flare angle associated therewith, wherein the maximum depth of each of said corrugations is about 3 mm, the minimum depth is about 1.5 mm, and wherein the flare angle $\alpha$ of each of said corrugations is about equal to 70°.

12. A bottle according to claim 10, each of said corrugations having a flare angle associated therewith, wherein the maximum depth of each of said corrugations is about 3.86 mm, the minimum depth is about 1.7 mm, and wherein the flare angle $\alpha$ of each of said corrugations is about equal to 59.74°.

13. A bottle according to claim 1, further comprising fold starters formed to project radially outwards adjacent the bottoms of the groove portions of said corrugations, said fold starters being uniformly distributed and angularly offset around the axis of the bottle from one corrugation to another.

14. A bottle according to claim 13, wherein each fold starter comprises a generator line or ridge line which extends in a plane containing the axis of the bottle and which is inclined relative to said axis by a determined angle $\gamma$.

15. A bottle according to claim 14, wherein the angle $\gamma$ lies in the range 0° to about 45°.

16. A bottle according to claim 14, wherein each of said corrugation groove portions have opposing outer wall portions which define a first flank and a second flank, and wherein said generator line or ridge line extends from one flank to the other flank of the corrugation.

17. A bottle according to claim 16, wherein said generator line or ridge line is connected to one of the flanks of the corrugation by a circular arc whose concave side faces towards the outside.

18. A bottle according to claim 16, wherein said generator line or ridge line is connected to the other flank of the corrugation via a rounded portion of minimum radius of curvature.

19. A bottle according to claim 14, wherein said generator line or ridge line extends downwards and outwards relative to the bottle.

20. A bottle according to claim 13, wherein each fold starter is shaped, in the midplane of the corrugation perpendicular to the axis of the bottle, in the form of a circular arc having its concave side facing towards the inside of the bottle.

21. A bottle according to claim 13, wherein each fold starter is shaped, in the midplane of the corrugation perpendicular to the axis of the bottle, in the form of a V-shape having its tip pointing towards the outside of the bottle.

22. A bottle according to claim 13, wherein the corrugations have a V-shaped cross-section with a rounded tip.

23. A bottle according to claim 13, wherein each fold starter has an angular extent $\epsilon$ about the axis of the bottle that lies in the range about 0.2 radians to $2\pi/n$ radians from one corrugation to another, n being the number of fold starters per corrugation.

24. A bottle according to claim 13, wherein said fold starters positioned on successive corrugations are angularly offset by $\pi/n$ radians along a longitudinal axis through the center of the bottle from one corrugation to the next successive corrugation, n being the number of fold starters per corrugation.

25. A bottle according to claim 13, wherein the number of fold starters per corrugation lies in the range 3 to 20.

26. An axially crushable bottle made of plastics material, the bottle comprising transverse corrugations over a major portion of its height, wherein said transverse corrugations have a depth, i.e., a dimension measured towards the axis of the bottle, that varies cyclically around the periphery of said corrugations between a maximum and minimum value, and wherein the bottle further comprises fold starters formed to project radially outwards from the bottoms of said corrugations, said fold starters being uniformly distributed and angularly offset around the axis of the bottle from one corrugation to another, and wherein the radial extent $\lambda$ of each of said fold starters in the midplane of said corrugation is about half the depth of said corrugation.

27. An axially crushable bottle made of plastics material, the bottle comprising transverse corrugations over a major portion of its height, said corrugations comprising right cylindrical portions alternating with depressed grooves, said grooves being formed with fold starters which project radially outward from the bottoms of said grooves and which are uniformly distributed and angularly offset around the bottle from one groove to another.

28. A bottle according to claim 27, wherein the depth of each corrugation groove varies continuously when going around the periphery of said corrugation groove from a maximum value to a minimum value, then from a minimum value to a maximum value, . . . , etc.

29. A bottle according to claim 27, wherein the bottom radius of each of said corrugation groove varies cyclically on going around the periphery of said corrugation groove, in correspondence with the depth of said corrugation.

* * * * *